United States Patent [19]

Harrison

[11] Patent Number: 4,651,613

[45] Date of Patent: Mar. 24, 1987

[54] MUSICAL BLOCK

[76] Inventor: Barbara G. Harrison, 12617 S. Greenwood Ave., Blue Island, Ill. 60406

[21] Appl. No.: 800,829

[22] Filed: Nov. 22, 1985

[51] Int. Cl.[4] ..... G10F 1/06

[52] U.S. Cl. ..... 84/95 C; 84/476; 446/397; 446/297

[58] Field of Search ..... 84/94 C, 95 C, 476; 446/397, 418, 297

[56] References Cited

U.S. PATENT DOCUMENTS

| | | | |
|---|---|---|---|
| 491,833 | 2/1893 | Bowen | 84/476 |
| 2,501,822 | 3/1950 | Kuyler | 84/95 |
| 2,879,685 | 3/1959 | Page | 84/476 |
| 3,299,762 | 1/1967 | Glass et al. | 84/95 |
| 3,638,524 | 2/1972 | Martin | 84/95 |
| 4,050,342 | 9/1977 | Suzuki et al. | 84/95 |

FOREIGN PATENT DOCUMENTS

| | | | |
|---|---|---|---|
| 592288 | 9/1947 | United Kingdom | 446/418 |

*Primary Examiner*—L. T. Hix
*Assistant Examiner*—Brian W. Brown
*Attorney, Agent, or Firm*—Henderson & Sturm

[57] ABSTRACT

A music box toy including a cube having a recess formed in each of the six faces, each of the recesses being disposed to receive a separate music box which plays a separate tune. The toy includes a cover disposed around the cube and the cover includes an aperture for each of the actuator shafts that extend outwardly from each of the six music boxes. The cover may be constructed to facilitate easy removal for cleaning or replacement by a separate cover.

10 Claims, 4 Drawing Figures

MUSICAL BLOCK

TECHNICAL FIELD

This invention relates to a music box toy and more particularly to music box toys which play a number of separate tunes.

BACKGROUND ART

Numerous music box toys have been used and have been popular, especially with young children. The conventional music box has been incorporated in a wide variety of toys, such as animal figures, simulated radios and televisions, carousels, and others. These toys are generally limited to producing a single tune which rapidly loses its soothing effect and becomes boring.

Those concerned with this and other problems recognize the need for an improved music box toy.

DISCLOSURE OF THE INVENTION

The present invention provides a music box toy including a cube having a recess formed in each of the six faces, each of the recesses being disposed to receive a separate music box which plays a separate tune. The toy includes a cover disposed around the cube and the cover includes an aperture for each of the actuator shafts that extend outwardly from each of the six music boxes. The cover may be constructed to facilitate easy removal for cleaning or replacement by a separate cover.

Alternate embodiments of the invention include a toy where the cover carries nursery symbols such as letters, numbers and animal appliques and the six separate music boxes play nursery tunes; a toy where the cover carries romantic symbols, such as hearts and flowers applied to a red satin and velvet material and the six music boxes play love songs; and a toy where the cover carries holiday symbols such as reindeer, evergreen trees and candy canes and the separate music boxes play Christmas songs.

An object of the present invention is the provision of an improved music box toy.

Another object is to provide a music box toy that plays a number of separate tunes.

A further object of the invention is the provision of a music box toy that is simple in structure and easy to manufacture.

Still another object is to provide a music box toy including a removable outer cover that is convenient to wash or replace.

A still further object of the present invention is the provision of a music box toy that is adaptable for use on a variety of occasions.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
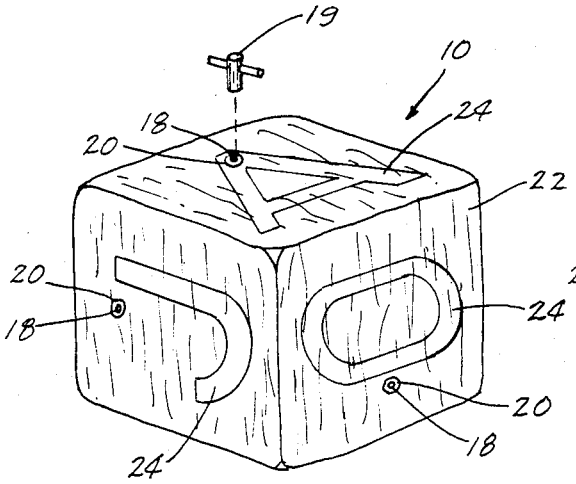
FIG. 1 is a perspective view of the music box toy of the present invention showing the music box actuator key removed from the actuator shaft.
Figure 2:
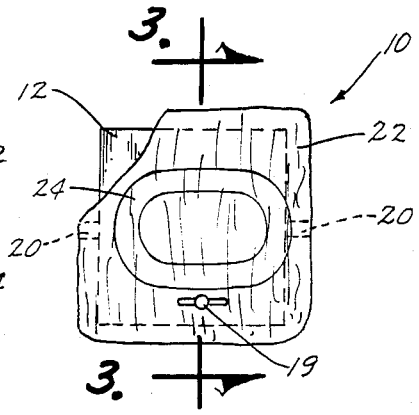
FIG. 2 is a front elevational view having a portion of the cover cut away to show the substrate cube.
Figure 3:
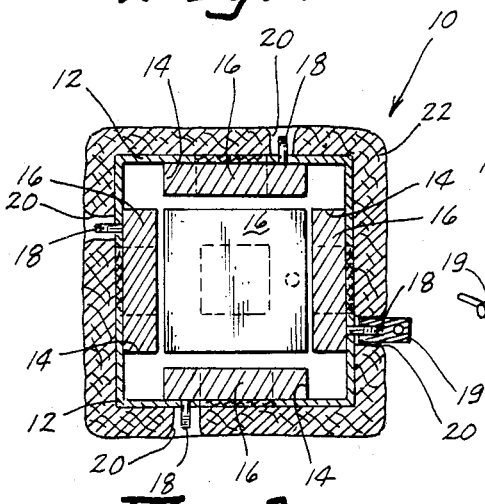
FIG. 3 is a sectional view taken along line 3—3 of FIG. 2 illustrating the orientation of the individual music boxes in the recesses formed in the substrate cube, and showing the apertures in the cover that receive the actuator shafts of the music boxes.
Figure 4:
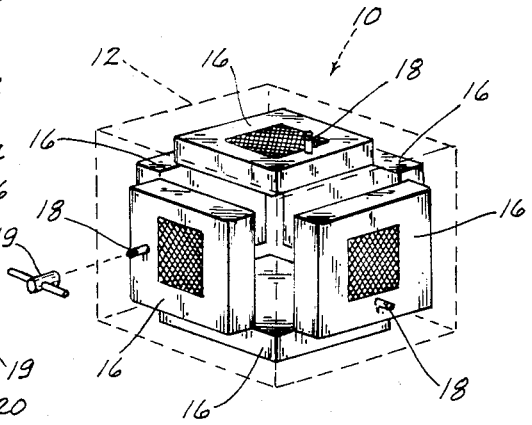
FIG. 4 is a perspective view showing the orientation of the six music boxes such that one music box is disposed in each of the six faces of the cube shown in dashed lines.

Referring now to the drawings, wherein like reference numerals designate identical or corresponding parts throughout the several views, FIGS. 1–4 show the music box toy (10) of the present invention including a substrate case (12) having a recess (14) formed in each of the six faces of the cube (12). A separate music box (16) is attached to the cube (12) and disposed in each of the recesses (14) such that the threaded actuator shaft (18) extends outwardly through apertures (20) in the cover (22). A threaded actuator key (19) is releasably secured to the actuator shaft (18).

Although the substrate cube (12) could be made of various materials, where the toy (10) is intended for young children, the cube (12) is preferably formed of a resilient material such as foam rubber. The embodiment illustrated in FIG. 1 shows the cover (22) carrying a letter symbol (24) on each face, it is to be understood that the cover (22) could be formed to be easily removable from the cube (12) for washing or replacement by a separate cover carrying different symbols (24).

In use, the key (19) is threaded onto one of the six shafts (18) and the key (19) is rotated to actuate the selected music box (16) to play the selected tune. When the user wishes to play a different tune, the key (19) is removed from one shaft (18) and attached to another shaft (18). When a single key (19) is used, it acts to identify the last tune played, however, it is to be understood that a separate key (19) could be attached to each of the six music boxes (16).

Thus, it can be seen that at least all of the stated objectives have been achieved.

Obviously, many modifications and variations of the present invention are possible in light of the above teachings. It is therefore to be understood that, within the scope of the appended claims, the invention may be practised otherwise than as specifically described.

I claim:

1. A music box toy comprising:

a substrate cube having a recess formed in each of the six faces of said cube;

a separate music box disposed in each of said recesses and attached to said cube, each music box including an actuator shaft extending outwardly therefrom;

a cover attached to and disposed around said cube, said cover including a plurality of apertures disposed to receive each of said actuator shafts; and an actuator key releasably secured to each of said actuator shafts.

2. The music box toy of claim 1 wherein said cube is formed of a resilient material.

3. The music box toy of claim 1 wherein said cube is formed of foam rubber.

4. The music box toy of claim 1, wherein each of six separate music boxes play a separate tune.

5. The music box toy of claim 1, wherein said cover is releasably attached to said cube.

6. The music box toy of claim 5, wherein said cover carries nursery symbols including numbers, letters and animal appliques.

7. The music box toy of claim 5, wherein said cover carries romantic symbols including hearts and flowers.

8. The music box toy of claim 5, wherein said cover carries holiday symbols including reindeer, evergreen trees and candy canes.

9. The music box toy of claim 1, wherein said actuator shafts are threaded and disposed to receive a threaded actuator key.

10. The music box toy of claim 9, wherein each threaded actuator shaft is disposed to receive a separate threaded actuator key.

* * * * *